United States Patent [19]

Kokubun et al.

[11] Patent Number: 4,662,522

[45] Date of Patent: May 5, 1987

[54] PAPER SELECTING APPARATUS

[75] Inventors: Shin-ichi Kokubun; Hiroshi Sato, both of Ebina, Japan

[73] Assignee: Fuji Xerox Co., Ltd., Tokyo, Japan

[21] Appl. No.: 710,024

[22] Filed: Mar. 11, 1985

[30] Foreign Application Priority Data

Mar. 14, 1984 [JP] Japan ..... 59-48316
Mar. 14, 1984 [JP] Japan ..... 59-48317

[51] Int. Cl.[4] ..... B07C 9/00

[52] U.S. Cl. ..... 209/656; 193/2 R; 193/38; 209/682; 209/684; 209/696; 271/279

[58] Field of Search ..... 209/656, 684, 696, 606, 209/659, 691, 682, 675, 658; 271/279, 299; 193/46, 47, 2 R, 38, 41; 235/484

[56] References Cited

U.S. PATENT DOCUMENTS 3,955,680 5/1976 Botula ..... 209/696
4,262,805 4/1981 Bankes et al. ..... 209/656
4,301,361 11/1981 Lees ..... 235/484

*Primary Examiner*—Randolph A. Reese
*Assistant Examiner*—Donald T. Hajec
*Attorney, Agent, or Firm*—Handal & Morofsky

[57] ABSTRACT

A paper selecting apparatus includes an upstream side transportation passage having an inclined bottom surface(s) held in the inclined state in the transverse direction, a lower stage transportation passage extending in continuation from the downstream end of the upstream side transportation passage, an upper stage transportation passage disposed above the lower one with a predetermined distance kept therebetween and a guide wall disposed between the upstream side transportation passage and the upper stage transportation passage for determining the direction of further movement of paper which has been displaced from the upstream side transportation passage to selectively bring it to either of both the upper and lower stage transportation passages in conformance with the width of paper to be selected.

7 Claims, 16 Drawing Figures

(a)

(b)

(a)

(b)

(a)

(b)

PAPER SELECTING APPARATUS

BACKGROUND OF THE INVENTION

1. Field of the Invention

The present invention relates to a paper selecting apparatus and more particularly to an apparatus for selecting papers discharged from a recording machine or the like in accordance with the width of papers to be selected.

2. Description of the Prior Art

As is well known, a conventional recording machine, for instance, electrographic copying machine is generally constructed such that size of copying papers to be used can be selected as required by an operator.

When a roll of paper is used for the conventional copying machine as starting paper, it is previously cut to a certain size which is selectively specified by an operator. Thus produced sheet papers are then subjected to electrographic copying to transfer an image on an original to them one by one and thereafter they are discharged from the copying machine.

In some copying machines in which the size of papers to be used can be selected as required, a few kinds of sheet papers cut to predetermined size are used for the machine. This kind of copying machine is usually constructed such that copying papers having different size are charged in the machine, papers having a size specified by an operator are selected therefrom an, image on an original is then transferred to the thus selected papers and finally copies are discharged from the machine one by one.

After completion of the copying operation in that way a number of copies discharged from the machine are received in a cage-shaped container or the like.

When originals having various sizes such as those for pamphlets or the like are electrographically copied in the machine as is often seen in an office, various sizes of copied papers are usually piled up at random in the container. Thus, there is a necessity for selecting copied papers in the container in accordance with paper size, particularly width of paper. However, when operating the conventional copying machine, the slecting operation takes a long time and therefore it is complicated and hard work for an operator.

SUMMARY OF THE INVENTION

Hence, the present invention has been made with the foregoing background in mind and its object resides in providing a useful paper selecting apparatus preferably employable for a recording machine, copying machine or the like in which a number of papers having different size are used.

Another object of the present invention is to provide a paper selecting apparatus of the above-mentioned type which is very simple in structure and therefore can be manufactured at an inexpensive cost.

Another object of the present invention is to provide a paper selecting apparatus of the above-mentioned type which can be easily operated by an unskilled operator.

To accomplish the above objects there is proposed according to the present invention an apparatus for selecting papers after completion of recording, copying or the like operation in accordance with their size, particularly width of paper, essentially comprising an upstream side transportation passage having an inclined bottom surface or surfaces inclined at a predetermined inclination angle as seen in the transverse direction, a lower stage transportation passage extending from the downstream end of the upstream side transportation passage, an upper stage transportation passage disposed above the lower stage transportation passage and a guide wall disposed between the upstream side transportation passage and the upper stage transportation passage for determining the direction of further movement of paper which has been displaced from the upstream side transportation passage to selectively bring it to either of both the upper and lower stage transportation passages in accordance with its width.

Other objects, features and advantages of the invention will become more clearly apparent from reading of the following description which has been prepared in conjunction with the accompanying drawings.

BRIEF DESCRIPTION OF THE DRAWINGS

The accompanying drawings will be briefly described below.

FIG. 13(*b*) is a vertical sectional view of the paper selecting apparatus in FIG. 13(*a*).

DESCRIPTION OF THE PREFERRED EMBODIMENTS

Now, the present invention will be described in greater detail with reference to the accompanying drawings which illustrate the preferred embodiments thereof.

Figure 1:
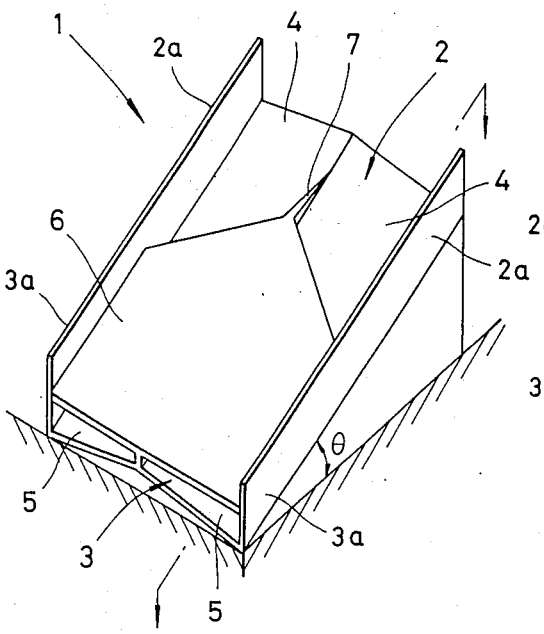
FIG. 1 is a perspective view of a paper selecting apparatus according to the first embodiment of the invention.
Figure 2:
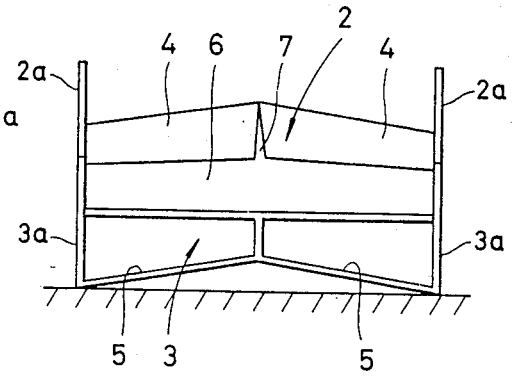
FIG. 2 is a front view of the paper selecting apparatus in FIG. 1.
Figure 3:
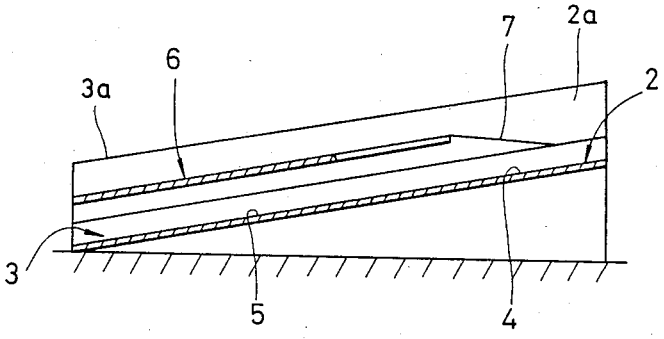
FIG. 3 is a vertical sectional view of the paper selecting apparatus taken in the longitudinal direction in FIG. 1.

First, description will be made below as to an apparatus for selecting recorded or copied papers in accordance with their size (hereinafter referred to simply as apparatus) according to the first embodiment of the invention with reference to FIGS. 1 to 5. The apparatus, as generally identified by reference numeral 1, is intended to be in use while it is located midway of an alongated transportation passage which is adapted to serve under the effect of gravity force of paper. As is apparent from FIG. 1, the whole apparatus is mounted in the inclined state having an inclination angle $\theta$ relative to the horizontal plane. The apparatus 1 is constructed such that the upstream side transportation passage 2 extends flush with the lower stage transportation passage 3 located downstream of the former. Both the transportation passages 2 and 3 have a flattened inverted V-shaped cross-sectional configuration as is best seen in FIG. 2 so that they have inclined bottom surfaces 4 and 5 which extend in the appreciably inclined state toward the side plates 2*a* and 3*a* which are located at their outermost end. Further, the apparatus 1 is provided with an upper stage transportation passage 6 located above the lower transportation passage 3 with a certain distance kept therebetween. The upper stage transportation passage 6 is formed with a guide wall 7 at the central part of the upstream side thereof and the guide wall 7 extends in the triangular configuration as seen from the side until its foremost end is jointed with the apex of both the inclined bottom surfaces 4 smoothly. As is best seen from FIG. 1, the upstream end of the upper stage transportation passage 6 is cut to the inverted V-shaped configuration.

Figure 4:
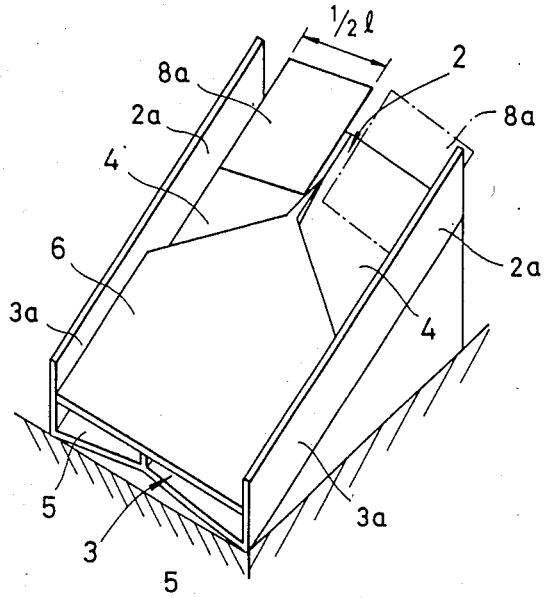
FIGS. 4(*a*) and (*b*) are a perspective view of the paper selecting apparatus respectively, particularly illustrating how a paper having a narrower width is selected by operating the apparatus.
Figure 4:
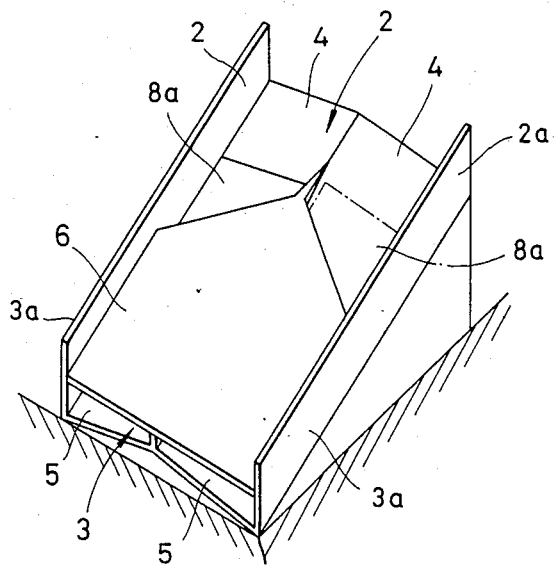
Figure 5:
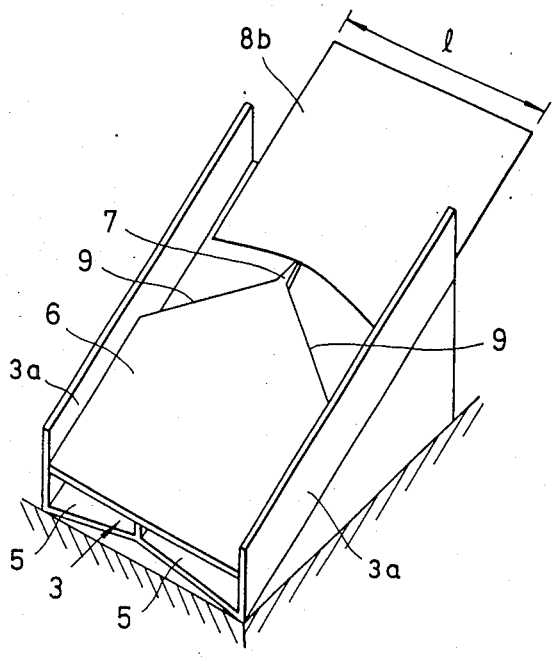
FIGS. 5(*a*) and (*b*) are a perspective view of the paper selecting apparatus respectively, particularly illustrating how a paper having a wider width is selected by operating the apparatus.
Figure 5:
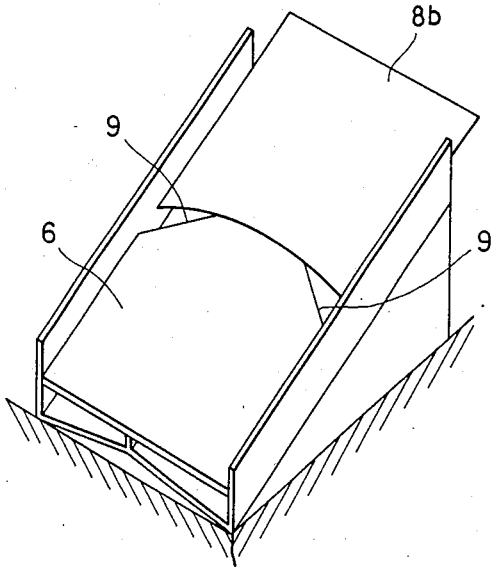

Next, description will be made below how selection is achieved with papers 8 using the apparatus 1 of the invention. As illustrated in FIG. 4(*a*), in the case of paper 8*a* having a width of $\frac{1}{2}$ L, it slides down along the one side plate 2*a* of the inclined bottom surfaces 4. As it slides down further, it reaches the lower stage transportation passage 3, as illustrated in FIG. 4(*b*). On the other hand, as illustrated in FIG. 5(*a*), in the case of paper 8*b* having a width of L, it slides down as if it is bridged over both the inclined bottom surfaces 4 of the upstream side transportation passage 2. As it slides down further, it reaches the guide wall 7 and it is then caused to advance along the guide wall 7 toward the upper stage transportation passage 6. During transportation of the paper 8*b* both the ends of the latter as seen in the transverse direction are hung down as illustrated in FIG. 5(*b*) but its transportation is achieved without any hindrance encountered until it is introduced onto the upper stage transportation passage 6, since they are lifted up by means of the inverted V-shaped edges 9 as it slides down.

Figure 6:
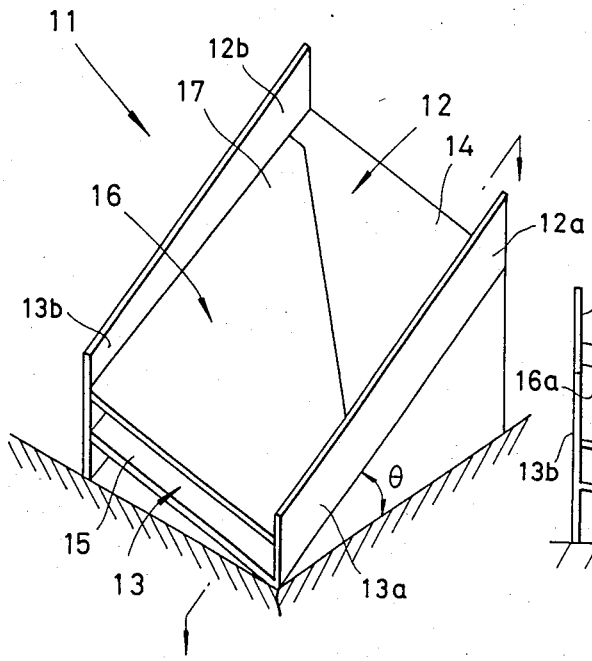
FIG. 6 is a perspective view of a paper selecting apparatus according to the second embodiment of the invention.
Figure 7:
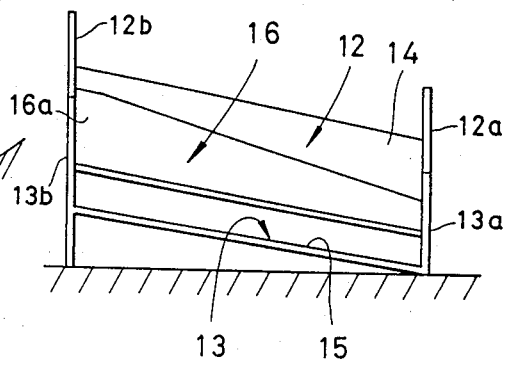
FIG. 7 is a front view of the paper selecting apparatus in FIG. 6.
Figure 8:
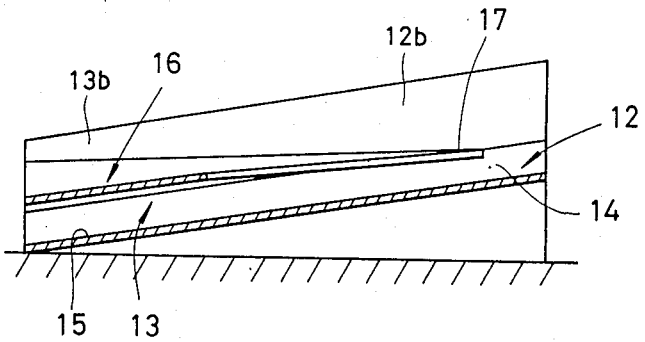
FIG. 8 is a vertical sectional view of the paper selecting apparatus taken in the longitudinal direction in FIG. 6.

FIGS. 6 to 9 schematically illustrate an apparatus according to the second embodiment of the invention. The apparatus, as generally identified by reference numeral 11, is intended to be in use while it is located midway of an elongated transportation passage which is adapted to transport papers under the effect of gravity force of the latter. As illustrated in FIG. 6, the whole apparatus 11 is mounted in the inclined state having a certain inclination angle of $\theta$ relative to the horizontal plane. The apparatus 11 is constructed such that the upstream side transportation passage 12 extends flush with the lower stage transportation passage 13 located downstream of the former. As is apparent from the drawings, both the transportation passages 12 and 13 have inclined bottom surfaces 14 and 15 of which apex is located at the one side thereof and they include side plates 12*a*, 12*b*, 13*a* and 13*b* at their both ends. Further, the apparatus 11 is provided with an upper stage transportation passage 16 located above the lower stage transportation passage 13 with a predetermined distance kept therebetween. The upper stage transportation passage 16 extends in parallel with the lower stage transportation passage 13 as seen in the transverse direction but it extends in the upstream direction such that a distance between both the upper and lower stage transportation passages 16 and 13 decreases. A part of the foremost end of the upper stage transportation passage 16 constitutes a guide wall 17 and it is jointed to the side plate 12*b* in the proximity of the apex of the inclined bottom surface 14 in the area of the upstream side transportation passage 12. As is best seen from FIG. 6, the upstream end of the upper stage transportation stage 16 is cut to the inclined configuration.

Figure 9:
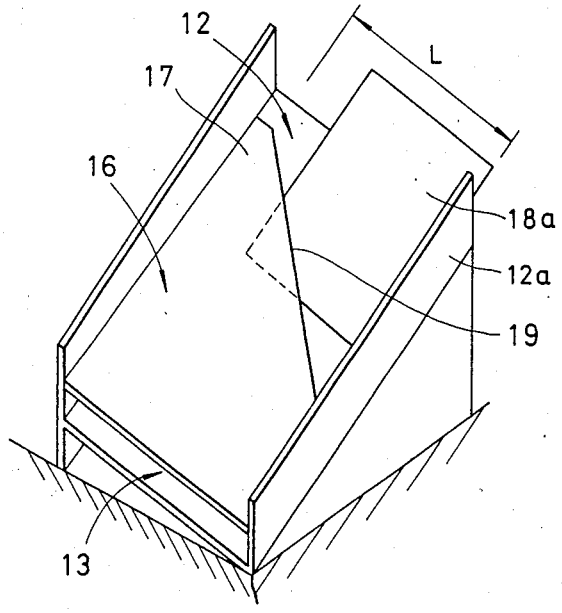
FIGS. 9(*a*) and (*b*) are a perspective view of the paper selecting apparatus respectively, particularly illustrating how a paper having a less or more width is selected by operating the apparatus.
Figure 9:
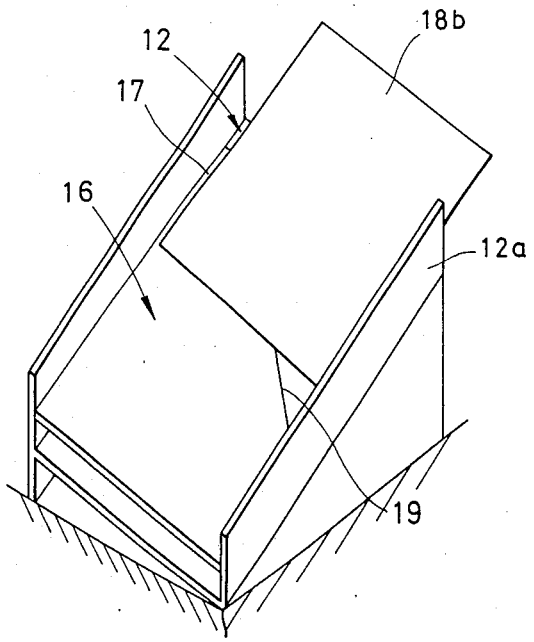

Next, description will be made below how selection is achieved with paper 18 using the apparatus 11 as constructed in the above-described manner. As illustrated in FIG. 9(*a*), in the case of paper 18*a* having a width less than L, it slides down on the inclined bottom surface 14 of the upstream side transportation passage 12 along the side plate 12*a*. As it slides down further, it is caused to advance in the area of the lower stage transportation passage 13.

On the other hand, in the case of paper 18*b* having a width wider than L, it slides down on the inclined bottom surface 14 of the upstream side transportation passage 12 along the side plate 12*a* in the same manner as in the case of paper 18*a*. As it slides down further, it reaches the guide wall 17 at the foremost end thereof so that it is held on the guide wall 17. As a result, it is conveyed onto the upper stage transportation passage 16 via the guide wall 17. It should be noted that paper 18*b* is displaced onto the upper stage transportation passage 16 while its foremost end part is lifted up by means of the inclined edge 19 of the upper stage transportation passage 16.

As will be readily understood from the above description, thus selected paper 8*a*, 8*b*, 18*a* or 18*b* is carried away from the apparatus toward the discharged paper tray via a transportation passage (not shown) which is connected to the downstream side of each of the lower stage transportation passage 3 or 13 and the upper stage transportation passage 6 or 16.

In each of the foregoing embodiments of the invention description has been made as to the case where paper slides down via the transportation passage under the effect of gravity force of paper but it should of course be understood that the invention should not be limited only to this. Alternatively, the invention may be applied to the case where a belt conveyor is employed as transportation passage. Obviously, in this case there is no necessity for inclining or tilting the whole apparatus 1 or 11 away from the horizontal plane.

Further, in the foregoing embodiments of the invention the apparatus is constructed such that the upstream side transportation passage 2 or 12 is made integral with the lower stage transportation passage 3 or 13 in continuation from the former. Alternatively, the upstream side transportation passage 2 or 12 may be made separate from the lower stage transportation passage 3 or 13. Further, alternatively, the latter may be stepped down from the former. At any rate what is required to be done is that arrangement is made in such a manner that paper 8 or 18 is smoothly displaced from the upstream side transportation passage 2 or 12 onto the lower stage transportation passage 3 or 13. Obviously, thing is the same with respect to the upper stage transportation passage 6 or 16.

Further, in the foregoing embodiments of the invention the apparatus is constructed such that paper having a wider width is brought onto the upper stage transportation passages 6 or 16 while it is held by means of the guide wall 17 during sliding-down movement on the upstream side transportation passage 2 or 12 but paper having a narrower width is brought onto the lower stage transportation pasage 3 or 13 directly. However, the present invention should not be limited only to this. Alternatively, as will be described later, arrangement may be made in such a manner that paper having a wider width is brought onto the lower stage transportation passage and paper having a narrower width is brought onto the upper stage transportation passage whereby required paper selection is carried out.

Figure 10:
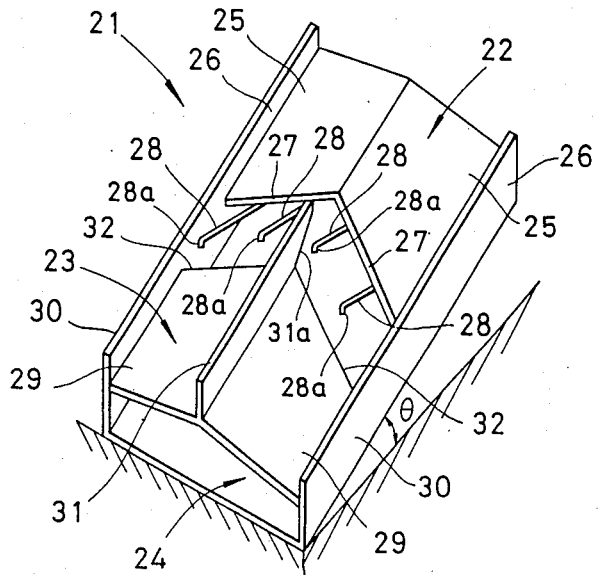
FIG. 10 is a perspective view of a paper selecting apparatus according to the third embodiment of the invention.
Figure 11:
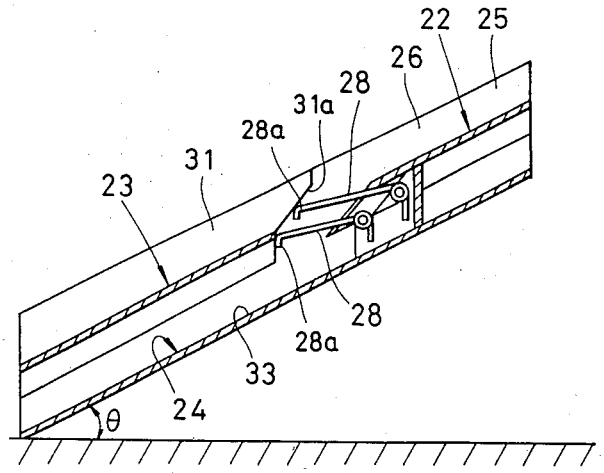
FIG. 11 is a vertical sectional view of the paper selecting apparatus taken in the longitudinal direction in FIG. 10.
Figure 12:
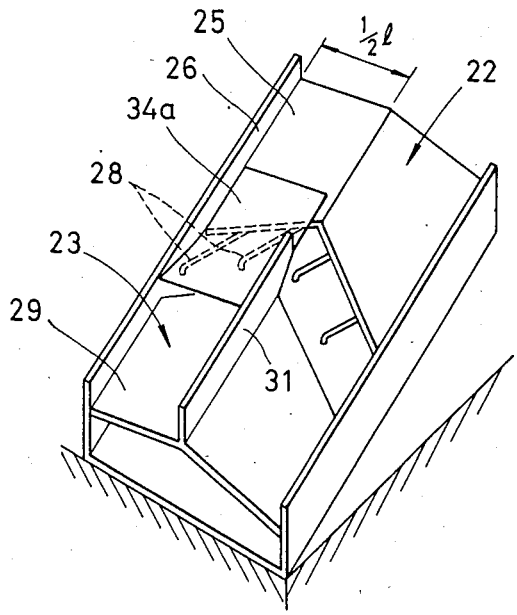
FIG. 12 is a perspective view of the paper selecting apparatus, particularly illustrating how a paper having a less width is selected by operating the apparatus.

Next, FIGS. 10 to 12 schematically illustrate an apparatus according to the third embodiment of the invention where paper having a wider width is brought onto the lower stage transportation passage and paper having a narrower width is brought onto the upper stage transportation passage.

The apparatus 21 is intended to be in use while it is located midway of a transportation passage which is adapted to transport paper under the effect of gravity force of paper. As schematically illustrated in FIG. 10, the whole apparatus is mounted in the inclined state having an inclination angle of $\theta$ relative to the horizontal plane. As is apparent from the drawing, the apparatus 21 is constructed such that the upper stage transportation passage 23 is disposed on an extension plane from the upstream side transportation passage 22 with a certain distance kept therebetween and a lower stage transportation passage 24 is disposed below the upper stage transportation passage 23. The upstream side transportation passage 22 has inclined bottom surfaces 25 having the flattened inverted V-shaped configuration of which apex is located in the middle of the upstream side transportation passage 22 and both the side ends of the inclined bottom surfaces are connected to side plates 26. The inclined surfaces 25 are inclined at a predetermined angle in a transverse direction with respect to the longitudinal axis of the passage. Further, the upstream side transportation passage 22 is formed with inclined edges 27 having the inverted V-shaped configuration as seen from the above at the downstream end thereof and four rod springs 28 which are designed as illustrated in the drawings are disposed below the inclined edges 27. The free end 28*a* of each of the rod springs 28 is oriented toward the upper stage transportation passage 23 and as is best seen from FIG. 11, it is projected above the inclined bottom surfaces 25 of the upstream side transportation passage 22. The upper stage transportation passage 23 is constituted by a combination of inclined bottom surfaces 29 located on an extension plane from the inclined bottom surfaces 25 of the upstream side transportation passage 22 and side plates 30 located on an extension plane from the side plates 25 of the same and a guide wall 31 upright on the apex of both the inclined bottom surfaces 29. The guide wall 31 is formed with an inclined guide face 31*a* and its upstreamside. This guide face 31*a* is oriented toward the upstream side transportation passage 22 and assumes the position located above the extension plane from the inclined bottom surfaces 25 of the upstream side transportation passage 22. Further, the upper stage transportation passage 23 is formed with inclined edges 32 at its upstream end which extend in parallel with the inclined edges 27 at the downstream end of the upstream side transportation passage 22. On the other hand, the lower stage transportation passage 24 is constituted by a combination of flat bottom surface 33 and side plates 30. As is best seen from FIG. 11, the upstream end part of the bottom surface 33 is extended up to the area located below the upstream side transportation passage 22.

Selecting operation of the apparatus 21 as constructed in the above-described manner is performed for paper 34 as follows.

Figure 13:
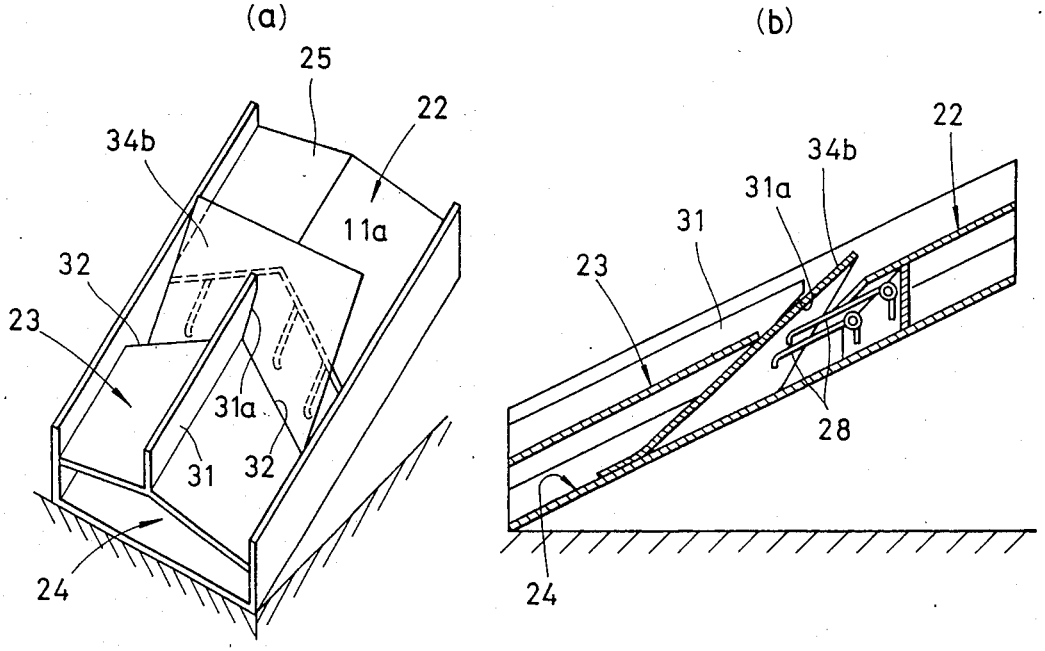
FIG. 13(*a*) is a perspective view of the paper selecting apparatus, particularly illustrating how a paper having a more width is selected by operating the apparatus.

When paper 34*a* having a width less than $\frac{1}{2}$ L is conveyed down on the one inclined bottom surface 25 of the upstream side transportation passage 22 along the one side 26 of the latter, it is brought upto the upper stage transportation passage 23 with the aid of resilient force of the rod springs 28, as illustrated in FIG. 12. On the other hand, when paper 34*b* having a width in the range of $\frac{1}{2}$ L to 1 L slides down on the upperstream side transportation passage 22, it is displaced downwardly while it is bridged across both the inclined bottom surfaces 25. As paper 34*b* slides down further, it collides with the guide face 31*a* of the guide wall 31 whereby it is introduced onto the lower stage transportation passage 24 along the contour of the guide face 31*a*, as illustrated in FIG. 13(*a*). During introduction of the paper 34*b* in that way the rod springs 28 are forcibly deflected downwardly by means of the paper 34*b* which is being introduced onto the lower stage transportation passage 24. It should be added that there is no fear of causing both the side edges of the paper 34*b* to be engaged to the upper stage transportation passage 23, since they are guided by means of the inclined edges 32 of the upper stage transportation passage 23.

Figure 14:
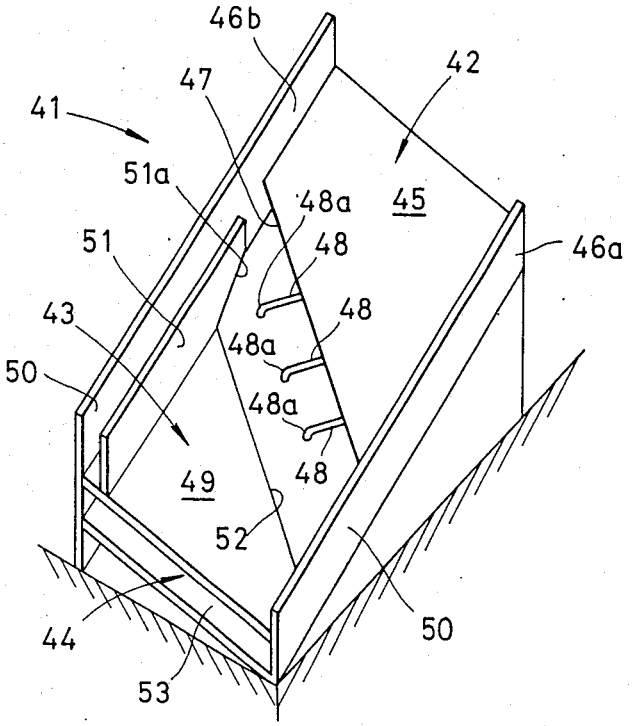
FIG. 14 is a perspective view of a paper selecting apparatus according to the fourth embodiment of the invention.
Figure 15:
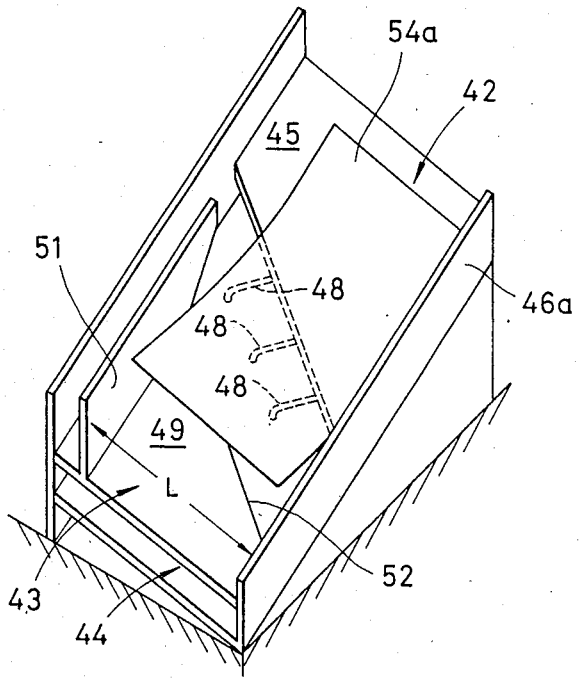
FIG. 15 is a perspective view of the paper selecting apparatus in FIG. 14, particularly illustrating how a paper having a less width is selected.
Figure 16:
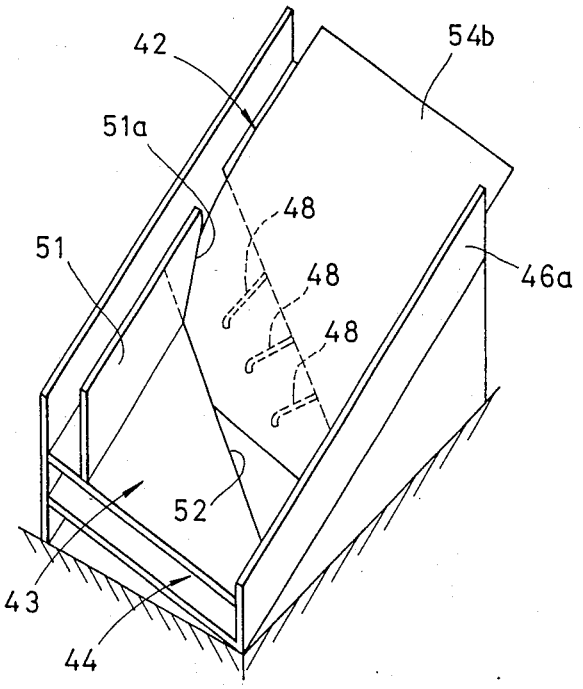
FIG. 16 is a perspective view similar to FIG. 15, particularly illustrating how a wider paper is selected.

Next, FIGS. 14 to 16 schematically illustrate an apparatus according to the fourth embodiment of the invention. The apparatus as generally identified by reference numeral 41 is intended to be in use while it is located midway of an elongated transportation passage which is adapted to transport paper under the effect of gravity force of the latter in the same manner as in the case of the foregoing embodiments. The whole apparatus 41 is mounted in the inclined state having an angle of $\theta$ as illustrated in FIG. 14. The apparatus 41 is constructed such that an upper stage transportation passage 43 is disposed on an extension plane from the upstream side transportation passage 42 with a properly determined distance kept therebetween and a lower stage transportation passage 44 is disposed below the upper stage transportation passage 43. The upstream side transportation passge 42 includes an inclined bottom surface 45 of which apex is located at the one side plate 46*b*. Further, the apparatus 41 includes two side plates 46*a* and 46*b* both of which are connected to the inclined bottom surface 45 constituting the upstream side transportation passage 42. As is apparent from the drawings, the upstream side transportation passage 42 is formed with an inclined edge 47 which extends in the direction as illustrated in the drawings, and three rod springs 48 having the illustrated configuration are disposed in the area located at the lower side of the inclined edge 47. The free end 48*a* of each of the rod springs 48 is oriented toward the upper stage transportation passage 43 and assumes the position located above the extension plane from the inclined bottom surface 45 of the upstream side transportation passage 42. Specifically, the upper stage transmission passage 43 is constituted by a combination of inclined surface 49 located on an extension plane from the inclined bottom surface 45 of the upstream side transportation pasasge 42 and side plates 50 located on extension planes from the side plates 46 of the same and a guide wall 51 stands upright at the position located in the vicinity of the apex of the inclined surface 49. The guide wall 51 is formed with an inclined guide face 51*a* at its upper front end and the guide face 51*a* is oriented toward the upstream side transportation passage 42 and assumes the position located above an extension plane from the area in the vicinity of the apex of the inclined bottom surface 45. Further, the upper stage transportation passage 43 includes an inclined edge 52 which extends in parallel with the inclined edge 47 at the downstream end of the upper stream side transportation passage 42. On the other hand, the lower stage transportation passage 44 is constituted by a combination of flat bottom surface 53 and side plates 50 and extends up to the area located below the upperstream side transportation passage 42.

Selecting operation of the apparatus 41 as constructed in the above-described manner is performed for paper 54 as follows.

When paper 54*a* having a width less than L is conveyed down on the inclined bottom surface 45 of the upstream side transportation pasasge 42 along the one side plate 46*a*, it is brought onto the upper stage transportation passage 43 with the aid of resilient force of the rod springs 48. On the other hand, when paper 54*b* having a width wider than L slides down on the upstream side transportation passage 42, it is displaced down on the inclined bottom surface 45 until it collides with the guide face 51*a* of the guide wall 51 whereby it is introduced onto the lower stage transportation passage 44 along the guide face 51*a*, as illustrated in FIG. 16. During introduction of the paper 54*b* in that way the rod springs 48 are forcibly deflected downwardly by means of the paper 54*b* which is being introduced onto the lower stage transportation passage 44. It should be noted that the lefthand end of the paper 54*b* as seen in the drawing is introduced onto the lower stage transportation passage 44 while it is guided by means of the inclined edge 52 of the upper stage transportation passages 43.

After the completion of selection is carried out for paper 24*a*, 24*b*, 54*a* or 54*b* in the above-described manner it is discharged away from the apparatus via a paper discharging passage (not shown) which is operatively connected to the downstream side of the upper stage transportation passage 43 or the lower stage transportation passage 44 until it is received on a discharged paper container or the like means.

The present invention has been described above with respect to the case where rod springs are employed for the apparatus as resilient means. Alternatively, leaf springs may be employed for the same purpose.

In the above-described embodiments of the paper selecting apparatus according to the present invention, there is provided, at each downstream end of both the lower stage transportation passage and the upper stage transportation passage, stopper means (not shown) such as doors or the like, for loading selected sheets of paper at the downstream ends of the transportation passages. By this stopper means, no selected sheets in the upper and lower stage transportation passages cannot be mixed up again after passing through the passages. Taking out of the selected sheets can be easily done by removing the stopper means or other measures.

What is claimed is:

1. An apparatus for selecting paper in accordance with their size, comprising:

(a) an upstream side transportation passage having an upstream and downstream end, and at least one inclined surface which is inclined at a predetermined inclination angle in a transverse direction with respect to the longitudinal axis of the passage;

(b) a lower stage transportation passage extending from and below the downstream end of said upstream side transportation passage;

(c) an upper stage transportation passage disposed above said lower stage transportation passage and downstream of said upstream side transportation passage; and (d) a guide wall for determining the direction of paper movement from the upstream side transportation passage, said guide wall being disposed between the upstream side transportation passage and the upper stage transportation pasasge in a longitudinal direction with respect to the upper stage passage to direct the paper to either the upper or lower stage transportation pasasge in accordance with the paper's width.

2. An apparatus as defined in claim 1 wherein the guide wall is located on said upper stage transportation passage in a longitudinal axis with respect to the direction of the transported paper such that paper having a narrow width is directed from the downstream end of the upstream side transportation passage toward the upper stage transportation passage, and said guide wall having an inclined guide face at its end opposite the downstream end of the upstream side transportation passage, such that when paper, displaced from the upstream side transportation passage, collides with the inclined guide face, it continues to travel onto the lower stage transportation passage, and when the displaced paper does not collide with the inclined guide face, it continues to travel onto the upper stage transportation passage.

3. An apparatus as defined in claim 2, wherein the upstream side transportation passage, the upper stage transportation passage and the lower stage transportation passage are supported in the inclined state so as to assure that paper slides down thereon under the force of gravity.

4. An apparatus as defined in claim 2, wherein the upstream side transportation passage has inclined surfaces in the shape of an inverted V-configuration situated in the transverse direction with respect to the longitudinal axis of the passage, and said guide wall is located at the middle of said upper stage transportation passage.

5. An apparatus as defined in claim 2, wherein a resilient means is disposed between the upstream side transportation passage and the upper stage transportation passage in the transported paper pathway to provide displacement of paper having a narrow width from the downstream end of the upstream side transportation pasasge to the upper stage transportation passage.

6. An apparatus as defined in claim 5, wherein a plurality of rod springs are employed as resilient means.

7. An apparatus as defined in claim 5, wherein a plurality of leaf springs are employed as resilient means.

* * * * *